United States Patent [19]

Cohen

[11] 3,935,874

[45] Feb. 3, 1976

[54] UMBRELLA ASSEMBLY

[76] Inventor: Helen Cohen, 251 Valentine St., Fall River, Mass. 02720

[22] Filed: Dec. 18, 1974

[21] Appl. No.: 533,815

[52] U.S. Cl. ..... 135/16; 135/33 C; 224/5.1; 248/43; 297/184

[51] Int. Cl.[2] ..... A45B 11/00; A45B 17/00; A45B 25/24

[58] Field of Search ..... 297/184; 248/40, 43, 111, 248/314; 135/16, 33 C; 224/5 E, 5 J, 5.1

[56] References Cited

UNITED STATES PATENTS

| | | | |
|---|---|---|---|
| 309,451 | 12/1884 | Ford | 135/7.1 |
| 602,662 | 4/1898 | Miller | 248/40 |
| 735,454 | 8/1903 | Bradbury | 248/40 |
| 1,460,821 | 7/1923 | Morris | 224/5.1 |
| 2,325,526 | 7/1943 | Major | 224/5.1 |
| 3,730,199 | 5/1973 | Thur | 135/33 C |

FOREIGN PATENTS OR APPLICATIONS

| | | | |
|---|---|---|---|
| 449,850 | 8/1949 | Italy | 248/43 |

*Primary Examiner*—Werner H. Schroeder
*Assistant Examiner*—Conrad L. Berman
*Attorney, Agent, or Firm*—Salter & Michaelson

[57] ABSTRACT

An umbrella assembly comprising a generally cylindrical housing, open at its top and closed at its bottom, a removable cover for closing the top of said housing, and a collapsible umbrella within said housing, said umbrella comprising a handle having extensible sections, the bottom of which is swivelly secured to the inner surface of the bottom wall of the housing, whereby when said umbrella is collapsed and the handle sections retracted the entire umbrella fits within said housing and when said cover is removed and said handle sections extended, the handle extends upwardly from said housing whereby when the umbrella is opened it is located substantially above the top edge of the housing, and means permanently securing the housing to any desired article, such as a chair or the like, whereby said assembly is permanently associated with said article so that the umbrella may be completely housed when not in use and may quickly and easily be set up to operative position whenever it is desired to use the umbrella in association with said article.

9 Claims, 10 Drawing Figures

UMBRELLA ASSEMBLY

BACKGROUND AND SUMMARY OF THE INVENTION

It has been found desirable to permanently attach a selfcontained unit comprising a collapsible umbrella to any desired article, for example, an article of furniture such as a chair, love seat, table etc., although, not limited thereto, since the present invention is also applicable to combination with other articles, such as boats, bicycles, etc.

More specifically, where articles of furniture are designed for outdoor use, or where boats, bicycles, etc. are used, it frequently becomes desirable to have an umbrella readily accessible for protection against the sun, rain, etc. The problem that has been encountered in the past is that where the umbrella is not permanently secured to the article with which it is associated, the umbrella is frequently not readily available when it is needed, either because it has been stored at a remote location, has become misplaced, or the like.

Accordingly, one of the basic objects of the present invention is to permanently secure and associate an umbrella assembly with the article with which it is to be used.

The broad idea of associating an umbrella with an article such as a chair, a boat, or the like, is not new, and is shown, for example, in Ford, U.S. Pat. No. 309,451, dated Dec. 16, 1884, and in Riggs U.S. Pat. No. 3,765,434, dated Oct. 16, 1973. In both of these cases, however, the umbrella assembly is readily removable from the article with which it is associated, thus presenting one of the problems which the present invention is designed to overcome. In addition, even if the umbrella assemblies shown in the Ford or Riggs patents were to be left mounted on the article with which the assembly is associated, there would be no means for housing or enclosing the umbrella during the periods which it is not in use, whereby the umbrella and its associated parts would be exposed to the elements and hence subject to deterioration, corrosion and the like.

It is therefore a further important object of the present invention to provide as an inseperable part of the umbrella assembly a housing or container within which the collapsed umbrella may be stored when the latter is not in use. In order to permit the housing or container to be of sufficiently small size so as not to interfere with normal use of the article with which the umbrella assembly is associated, the umbrella handle is made up of a plurality of extensible sections, which, when retracted, conveniently fit within the housing, it being understood that when it is desired to use the umbrella, the handle, which is secured to the interior of the housing, is extended so that it extends outwardly from the housing, after which the umbrella is conventionally opened for its intended use.

Other features of my invention comprise the fact that the bottom section of the umbrella handle is swivelly secured to the bottom wall of the housing, whereby the extended umbrella handle may be pivotally moved within the limits defined by the upper edge of the housing to permit some degree of adjustability with respect to the position of the umbrella when in use. Also, I have provided a unique arrangement whereby the mounting bracket which secures the bottom end of the housing to the article with which it is associated actually forms the bottom wall of the housing, there being means provided on said bottom wall for making its junction with the bottom edge of the housing substantially water tight.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
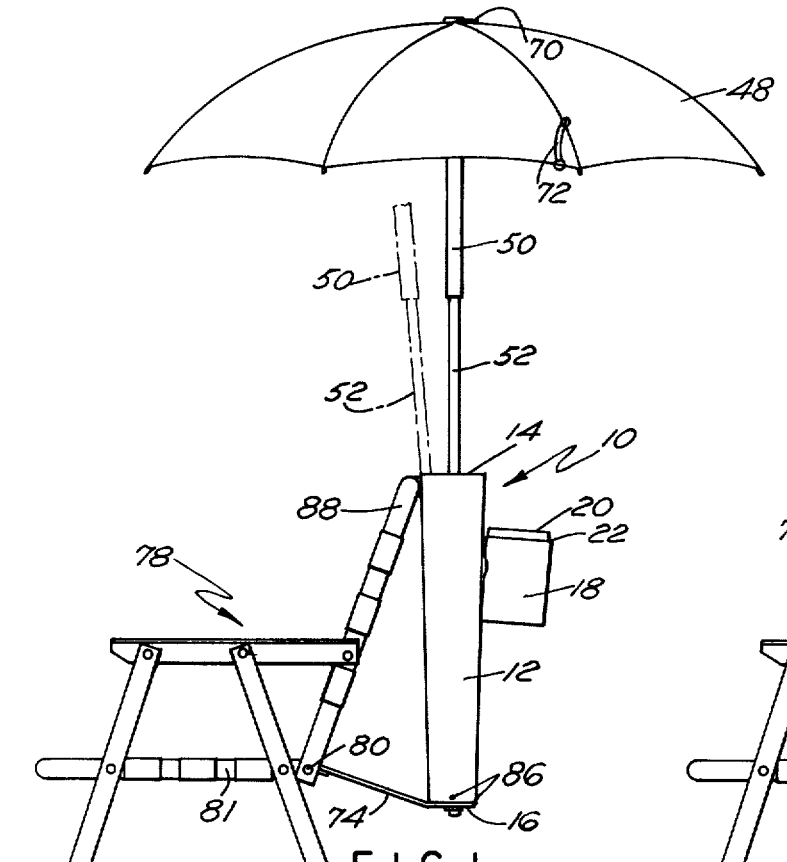
FIG. 1 is a side elevational view showing the present invention in combination with a chair and in operative position.

Referring now to the drawings, there is shown generally at 10 an umbrella assembly comprising a generally cylindrical housing 12 preferably constructed of a light-weight metal, such as aluminum, so as to be rust-proof. The container 12 is open at its top end 14 but has a bottom wall 16 closing off the bottom end of the housing. For reasons hereinafter to become apparent, the housing 12 tapers outwardly a slight degree from bottom to top, as illustrated most clearly in FIGS. 1, 2 and 3. A removable cover 18, preferably constructed of the same light-weight metal as housing 12, is adapted to frictionally seat at the top end of the housing, whereby the housing may be closed, when desired. It will specifically be noted that the cover 18 is provided with a reduced marginal flange 20 defining a shoulder 22, said marginal flange being adapted to be snuggly received within the top edge of housing 12 until shoulder 22 abuts said top edge, thus providing a relatively secure, water-tight seal when the cover is in place. The cover 18 is provided with a small aperture 24 which is adapted to cooperate with a clip member 26 secured to the outer surface of housing 12, as shown most clearly in FIG. 3, whereby when cover 18 is removed it may be inverted and aperture 24 receives clip member 26 to releasably maintain the cover as illustrated in FIG. 1 whereby the cover will always be accessible and the likelihood of the cover being misplaced when not in use is eliminated.

Figure 4:
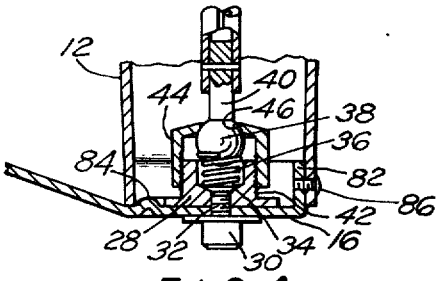
FIG. 4 is a fragmentary sectional view on an enlarged scale showing the swivel mounting of the umbrella handle at the bottom of the housing.

Referring now to FIG. 4, it will be seen that a bushing 28 is secured to the inner surface of said bottom wall by means of member 30 having a threaded stud 32 threadedly engaged with said bushing. The bushing 28 has a central seat 34 in which is positioned a coil spring 36, the upper end of which receives ball 38 secured to the bottom of shaft 40. As will be noted, bushing 28 is externally threaded as at 42, said external threads threadedly receiving a locking collar 44 having a central opening 46 through which shaft 40 extends. It will therefore be seen that the cooperation between spring 36, ball 38 and locking collar 44 effects a swivel mounting for shaft 40, and as a result of the resilient bias of spring 36, a frictional drag will always oppose any movement of shaft 40 whereby to releasably maintain the latter in any desired rotary or angular position.

Figure 6:
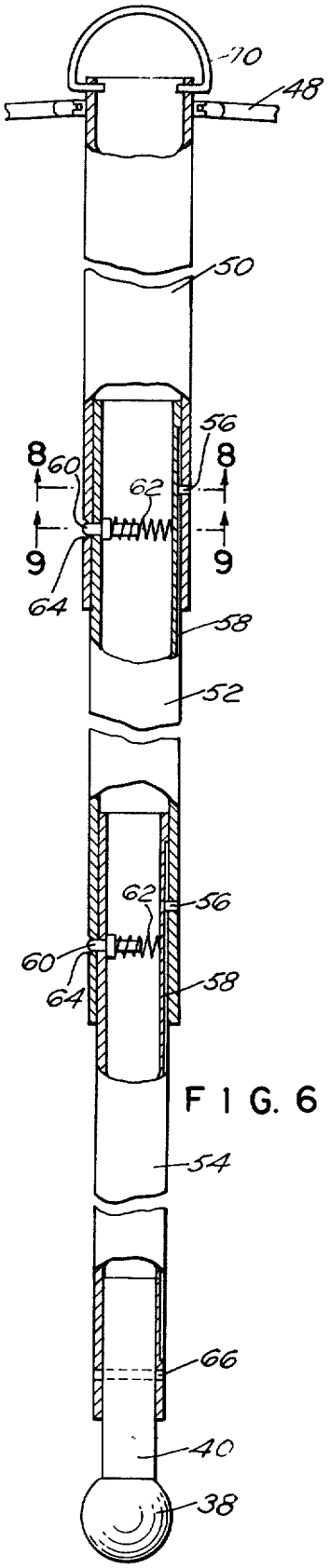
FIG. 6 is a fragmentary view showing the umbrella handle in extended position.
Figure 7:
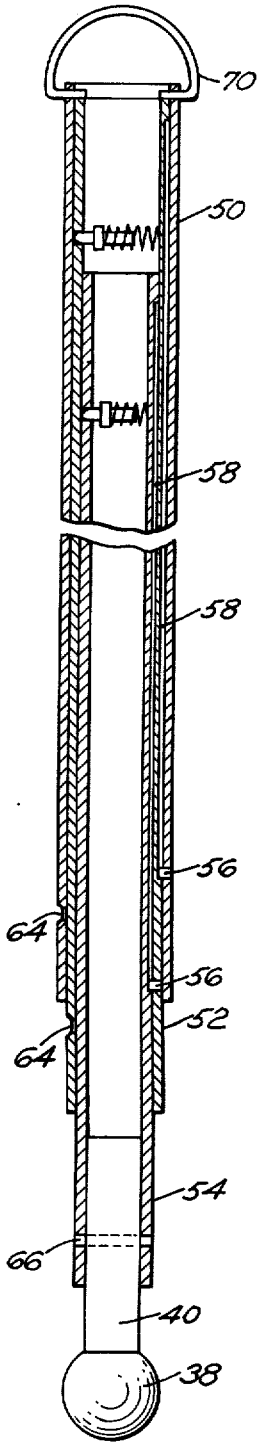
FIG. 7 shows the umbrella handle in retracted position.
Figure 8:
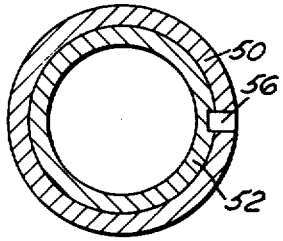
FIG. 8 is an enlarged section taken on line 8—8 of FIG. 6.
Figure 9:
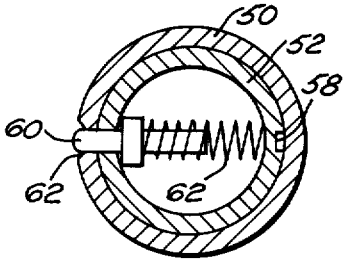
FIG. 9 is an enlarged section taken on line 9—9 of FIG. 6.

Mounted to the interior of housing 12 is an umbrella 48 of conventional construction, said umbrella having a handle comprising extensible and retractable sections 50, 52, and 54, see FIGS. 6 and 7. As will be noted, section 54 telescopes within section 52, while section 52 telescopes within top section 50. Sections 50 and 52 each carry an inwardly extending pin 56 which slidably engages within longitudinally extending grooves 58 provided in the outer surface of the cylindrical walls of sections 52 and 54 to guide said sections as they extend and retract with respect to each other and to maintain said sections properly aligned and so that they cannot rotate with respect to each other. Sections 52 and 54 each carry outwardly extending pins 60, said pins being resiliently urged in an outward direction by means of springs 62. Sections 50 and 52 are each provided with openings 64 whereby when the sections are extended with respect to each other as illustrated in FIG. 6, the openings 64 are adapted to receive the pins 60 to maintain said sections in their extended position. When it is desired to retract the sections so that they may telescope within each other, the pins 60 are manually depressed, whereby said sections are then free to telescope and retract to the position illustrated in FIG. 7.

Figure 3:
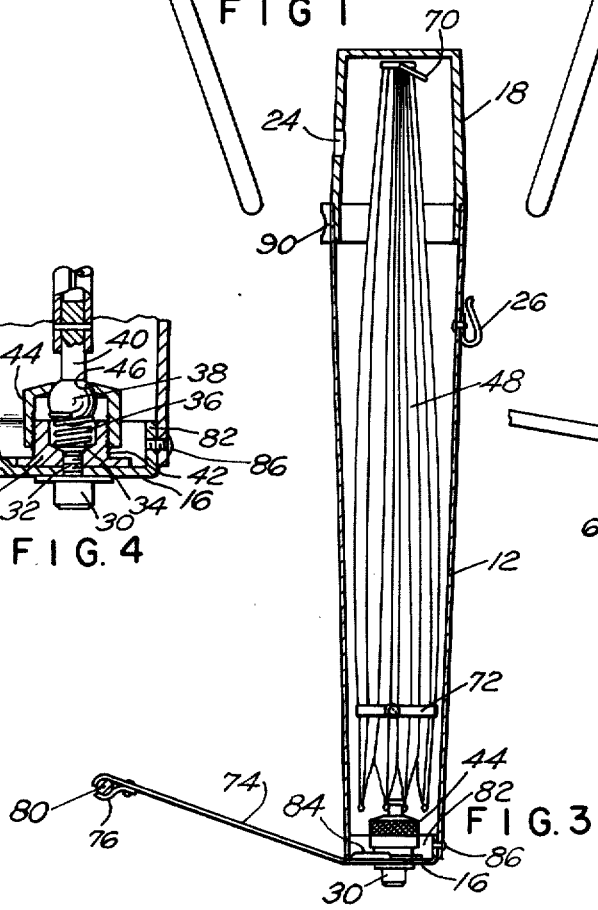
FIG. 3 is a sectional view on an enlarged scale of the umbrella assembly per se with the umbrella in non-operative position.
Figure 5:
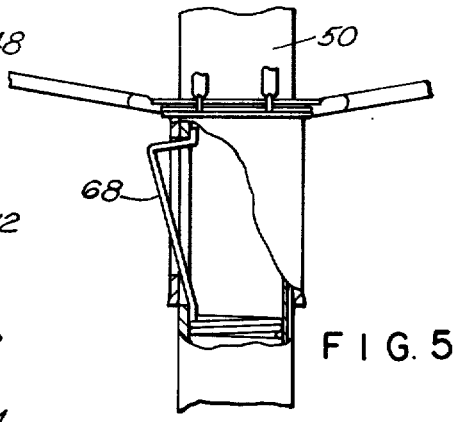
FIG. 5 is a fragmentary view showing the means for maintaining the umbrella in open position.

As will be seen most clearly in FIGS. 4 and 6, the bottom section 54 is secured to shaft 40 by means of pin 66, whereby the umbrella 48 is actually secured within housing 12. It will be understood that when sections 50, 52 and 54 are telescopingly retracted, as illustrated in FIG. 7, and when umbrella 48 is closed or collapsed, the entire umbrella fits within housing 12, as shown in FIG. 3. Thus, the umbrella is entirely enclosed when cover 18 is secured in position at the top of housing 12. When it is desired to use the umbrella 48, cover 18 is removed and is hooked onto clip 26 so as to be suspended thereby as illustrated in FIG. 1. The top of umbrella 48 is then grasped and pulled upwardly whereupon the handle sections extend and automatically lock in their extended position after which the umbrella is opened to assume the position illustrated in FIG. 1. Conventional spring locking means 68, shown in FIG. 5, are associated with the umbrella to releasably maintain the latter in its open or operative position, but since these means are conventional and form no part of the present invention, no further description of same is deemed to be necessary at this time. It will be noted that at the upper extremity of section 50 there is provided a pivotally mounted bail 70 which may be grasped to facilitate upward pulling movement of the umbrella when the latter is being extended upwardly from housing 12. Likewise, the umbrella 48 is provided with a conventional tie strap 72 having releasable fastening means to maintain the umbrella compactly bunched when the umbrella is in the closed position, as illustrated in FIG. 3.

Figure 2:
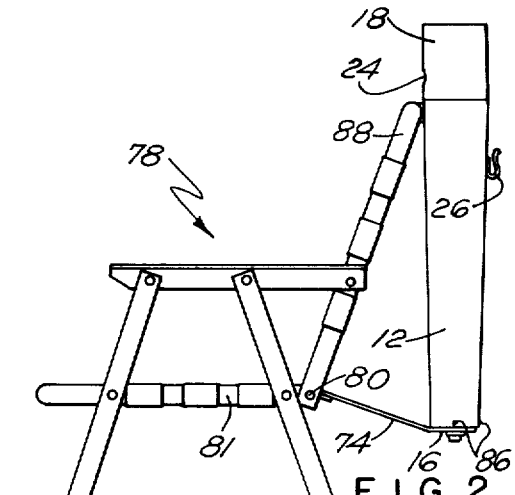
FIG. 2 is the assembly of FIG. 1 in non-operative position.

The bottom wall 16 of housing 12 actually is an integral part of bracket 74, said bracket having clamp means 76 at its free outer end for securement to an article with which umbrella assembly 10 is to be associated. More specifically, since a primary use of the instant invention is in association with a chair, such as a patio chair or the like, shown generally at 78, bracket 74 is preferably clamped to the rear cross bar 80 of seat 81 of said chair, whereby housing 12 is maintained in a substantially upright position, as illustrated in FIGS. 1 and 2. In order to maintain the joint between bottom wall 16 and the bottom edge of housing 12 substantially water-tight, bottom wall 16 is provided with an upstanding flange 82, see FIGS. 3 and 4, which extends around the periphery of wall 16, except, of course, for the portion from which bracket 74 extends. At this area, bottom wall 16 is provided with an integrally formed upwardly extending arcuate rib 84 whereby it will be seen that the entire periphery of wall 16 interfits within the bottom edge of housing 12 to effect a substantially water-tight seal. Wall 16, and hence bracket 74, is secured to housing 12 by any suitable means, such as screw 86 which interconnects the lower edge of housing 12 with flange 82.

Figure 10:
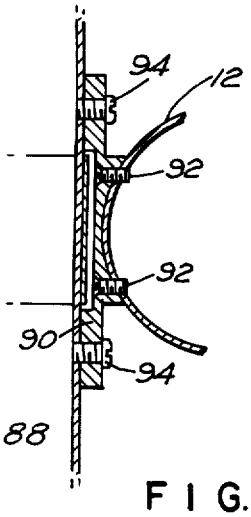
FIG. 10 is a fragmentary plan view showing the means for mounting the top of the housing to the associated article.

The top edge of housing 12 is secured to the top of the back 88 of chair 78 by an suitable means, such as bracket 90 (FIG. 10) which is secured to housing 12 by means of screws 92 and then is secured to the top of chair back 88 by means of screws 94.

When the umbrella 48 is not in use, it will be understood that the umbrella is collapsed as illustrated in FIG. 3, the tie strap 72 is secured around the collapsed umbrella to maintain it compactly folded. The handle sections 50, 52 and 54 are telescopingly retracted whereby the entire collapsed and retracted umbrella fits within container 12 and cover 18, as illustrated in FIG. 3. Since the container or housing 12 is substantially water-tight, deterioration of the umbrella due to moisture is prevented, this being important since the umbrella will normally be associated with an article that is used outdoors. As previously stated, the housing 12 and cover 18, as well as associated hardware, is preferably constructed of a relatively light-weight, rust-proof, metallic material, such as aluminum, for example. When it is desired to use the umbrella 48, cover 18 is manually removed and is hung on clip 26 so that it will be readily available when again needed. Bail 70 is then grasped and the umbrella is pulled upwardly whereupon the handle sections automatically extend and lock in their extended position. Tie strap 72 is then unfastened and the umbrella 48 opened in conventional fashion, as illustrated in FIG. 1. The swivel mounting at the bottom of the handle of the umbrella in combination with the tapered configuration of housing 12 permits the umbrella handle to be shifted within the housing, as illustrated by the broken lines in FIG. 1. This permits some degree of adjustment with respect to the position of the umbrella as it relates to the article with which it is associated, such as chair 78. As previously stated, the umbrella assembly 10 need not necessarily be associated with a chair, but rather can be associated with any article adapted for outdoor use where the permanent presence of an umbrella would be desirable.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An umbrella assembly comprising an elongated generally cylindrical housing having a bottom end wall but open at its top end, a removable cover attachable to said top end for closing same, a collapsible umbrella mounted within said housing, said umbrella having a handle comprising a plurality of interconnected extensible sections, means swivelly securing the bottom one of said sections to said housing bottom wall, said sections being dimensioned whereby when they are retracted and the umbrella collapsed, the entire umbrella fits within said housing, and when said sections are extended and the umbrella opened, said handle extends outwardly from said top end of said housing for a substantial distance, said swivel means permitting the extended handle to pivot within said housing until the handle engages the top edge of the latter.

2. In the assembly of claim 1, said swivel means having means associated therewith for imparting a frictional drag to the pivotal movement of said handle.

3. In the assembly of claim 1, said housing tapering outward from bottom to top to increase the extent of pivotal movement of said handle within said housing.

4. In the assembly of claim 1, said housing having a clip member secured to the outer surface thereof, said cover having means for detachably receiving said clip member whereby said cover may be removably attached to said housing after removal of the cover from the top of said housing.

5. In the assembly of claim 1, the top most section of said handle having a pivotally mounted bail attached to the end thereof, whereby said bail may be grasped to facilitate removal and extension of said handle sections from said housing.

6. In the assembly of claim 1, a mounting bracket secured at one end to the bottom of said housing and at its other end to an article with which said umbrella assembly is permanently associated.

7. In the assembly of claim 6, said article comprising a furniture piece having a seat portion and a back portion, said bracket being secured to said furniture piece at an area adjacent the back edge of said seat portion, said housing being disposed in substantially vertical disposition with the top end of said housing being located adjacent the top edge of said back portion, and means securing said housing top end to said back portion top edge.

8. In the assembly of claim 6, said bottom wall comprising an integral portion of said bracket, and means carried by said bottom wall cooperating with the lower end of said housing for maintaining the latter substantially water-tight.

9. In the assembly of claim 8, said means comprising a generally circular, integrally formed, upward extension that fits snuggly within the bottom end of said housing.

* * * * *